United States Patent [19]

Granzow et al.

[11] Patent Number: 4,655,391

[45] Date of Patent: Apr. 7, 1987

[54] CONTAINER HAVING TAMPER-INDICATING MEANS

[75] Inventors: Robert H. Granzow, Miamisburg; Dale L. Placke, Dayton; Harry L. Howett, Brookville, all of Ohio

[73] Assignee: NCR Corporation, Dayton, Ohio

[21] Appl. No.: 715,860

[22] Filed: Mar. 25, 1985

[51] Int. Cl.[4] ..... E05G 1/00

[52] U.S. Cl. ..... 232/43.1; 109/43; 70/432; 70/439; 232/43.5

[58] Field of Search ..... 232/43.3, 43.5, 43.1, 232/36, 37; 109/38, 43, 44; 70/432, 439, 440, 441

[56] References Cited

U.S. PATENT DOCUMENTS

| | | | |
|---|---|---|---|
| 3,276,835 | 10/1966 | Hall | 312/333 |
| 3,854,655 | 12/1974 | Armstrong | 232/4 R |
| 4,131,001 | 12/1978 | Gotto | 70/14 |
| 4,253,016 | 12/1981 | Hirose | 235/381 |
| 4,275,667 | 6/1981 | Hilton | 109/44 |
| 4,337,393 | 6/1982 | Hilton | 235/487 |
| 4,508,260 | 4/1985 | Keir et al. | 232/43.1 |
| 4,529,118 | 7/1985 | Granzow et al. | 232/43.3 |
| 4,529,119 | 7/1985 | Granzow et al. | 232/43.3 |
| 4,570,548 | 2/1986 | Martin et al. | 109/44 |

FOREIGN PATENT DOCUMENTS

| | | |
|---|---|---|
| 0010598 | 5/1980 | European Pat. Off. . |
| 549160 | 1/1923 | France . |
| 103173 | 1/1924 | Switzerland . |
| 998148 | 7/1965 | United Kingdom . |
| 2039264A | 6/1980 | United Kingdom . |
| 2079832A | 1/1982 | United Kingdom . |

OTHER PUBLICATIONS

Examiner's Report from U.K. Appln. No. 8202932; Filed Feb. 3, 1983, by Grant G. H. Keir et al.

U.S. application Ser. No. 522,448 filed Aug. 12, 1983 by Robert H. Granzow et al.

U.S. application Ser. No. 522,449 filed on Aug. 12, 1983 by Robert H. Granzow et al.

U.S. application Ser. No. 722,954 filed Apr. 12, 1985 by Harry L. Howett et al.

*Primary Examiner*—Gene Mancene

*Assistant Examiner*—John G. Weiss

*Attorney, Agent, or Firm*—Albert L. Sessler, Jr.

[57] ABSTRACT

A currency cassette for an automated teller machine is provided with a counter for maintaining a count of the number of times that a currency access door of said cassette has been opened, and is further provided with an interrupt mechanism for prohibiting said count from exceeding a predetermined amount and returning to a zero count. Reset mechanism is provided for disabling the interrupt mechanism to permit the counter to be reset to zero when the cassette is returned from the automated teller machine to a central location for reloading with currency when the currency contained in the currency cassette has been depleted by dispensing through the automated teller machine.

9 Claims, 9 Drawing Figures

CONTAINER HAVING TAMPER-INDICATING MEANS

BACKGROUND OF THE INVENTION

This invention relates to a container or cassette for storing items within and having a mechanism for indicating when unauthorized opening of the container has taken place. Such a container may, for example, be a cassette for storing currency therein, designed for use in an automated teller machine (ATM) which is capable of automatic dispensing of currency in response to the direction of a customer who provides proper identification and directions for a withdrawal from the customer's account.

Currency cassettes used with automated teller machines are frequently provided with two openings and complementary doors. Currency is loaded into the cassette through a first opening which may be in the top of the cassette, and is dispensed through a second opening, which may be at one end of the cassette. With the cassette operatively positioned within the ATM, the door of the second opening is held open, and a picker mechanism of the ATM picks one bill at a time from the cassette for dispensing by the ATM. Such a cassette is, for example, shown in U.S. patent application Ser. No. 522,449, filed Aug. 12, 1983, inventors Robert H. Granzow et al., assigned to the assignee of the present application, now U.S. Pat. No. 4,529,119, issued July 16, 1985. A similar cassette is disclosed in U.S. Pat. No. 4,275,667, issued June 30, 1981, inventor Graham H. Hilton.

Other cassettes of various types having tamper indicating and/or prevention mechanisms are disclosed in U.S. application Ser. No. 509,488, filed June 30, 1983, inventors Keir et al., now U.S. Pat. No. 4,508,260, issued Apr. 2, 1985, and in U.S. patent application Ser. No. 522,448, filed Aug. 12, 1983, inventors Granzow et al., now U.S. Pat. No. 4,529,118, issued July 16, 1985, both assigned to the assignee of the present application.

Loading of cassettes with currency is normally done at a central location, such as a central bank. The upper door or lid is then closed and may be secured, as by a seal, for example, which would reveal any unauthorized attempt to open the cassette. The cassettes may then be transported to ATMs at remote locations by appropriate conveyance, such as an armored truck. After the currency in a cassette has been exhausted, or substantially exhausted, it is transported back to the central location for reloading.

In order to minimize the likelihood of unauthorized opening of the second door of a cassette to extract currency through the associated opening, it is desirable to provide some type of security feature which will either prevent the unauthorized opening of said second door, or will provide some indication that such an unauthorized opening has taken place. On the other hand, it is necessary to permit at least one opening of said second door to permit said door to open at the time the cassette is first inserted into its ATM for currency dispensing.

To meet this need, various types of "secure" cassettes have been developed. These "secure" cassettes generally have mechanical or electrical systems which prevent unauthorized access into the cassette by such persons as the persons delivering the cassettes to the ATMs and the persons installing the cassettes in the ATMs.

In one prior-art cassette, for example, as shown in the previously-mentioned U.S. Pat. No. 4,275,667, the door associated with the opening through which currency passes for dispensing by the ATM is locked in a closed position after the cassette is loaded with currency, and during transit to the ATM in which it is to be used. As the cassette is moved into engagement with the ATM, the door is opened by engagement with protruding elements of the ATM, in order to permit the ATM to extract currency from the cassette. When the number of bills remaining in the cassette decreases to a predetermined minimum, an authorized person removes the cassette from the ATM, and it is sent back to the central location for reloading.

As the cassette is removed from the ATM, the door closes and is latched in the closed position before the cassette is completely removed from the ATM. The cassette is constructed so that the door associated with the bill dispensing opening may be opened once, as when it is inserted into the ATM. When it is removed from the ATM, it is latched, as previously mentioned, and must then be returned to the central location for opening and refilling.

The above arrangement prevents unauthorized access to the cassette, but is somewhat lacking in flexibility. For example, it may sometimes be necessary to remove the cassette from the ATM in order to clear currency jams. A cassette having the above construction would then have to be sent back to the central location for service, even though the currency therein was not exhausted, since the door to the currency exit opening would be latched and could not be opened again without service.

In a second type of cassette, such as is disclosed in the previously cited U.S. patent application Ser. No. 522,449, the door in question can be opened a predetermined number of times before it becomes latched shut. The number of times that the door has been opened is shown on an indicator in the cassette. A requirement can be made, by the bank or other institutions using the cassette, that a written explanation be provided each time the door is opened, thus maintaining a degree of security in connection with use of the cassette.

It will be noted that both of the above arrangements involve a latching of the currency exit door after one or more openings of said door. In some instances, it may be desirable to provide some degree of cassette security without any latching of the cassette door. One advantage of such an arrangement is lower cost and decreased complexity for such a cassette. A second advantage is the elimination of possible damage to an ATM or a cassette which might otherwise take place during an attempt to force a latched cassette into an ATM.

SUMMARY OF THE INVENTION

In the container of the present invention, security is provided by maintaining a count of the number of times that a container door is opened, while preventing such count from exceeding a predetermined maximum or from cycling past said maximum number back to an initial or zero number.

In accordance with one embodiment of the invention, a tamper indicating container comprises a casing having first and second apertures therein; first door means operatively associated with said first aperture and movable between open and closed positions; second door means operatively associated with said second aperture and movable between open and closed positions; means to secure said second door means in closed position and to provide an indication when said second door means has been opened; means for moving said first door means to open position to enable items to be removed from said container and movable to said closed position after a desired number of items have been removed therefrom; indicator means movable incrementally from an initial position to a maximum count number position to provide an indication of the number of times up to the maximum that the first door means has been opened; advancing means for advancing said indicator means incrementally each time up to the maximum that said first door means is opened; interrupt means for preventing the advancing means from advancing the indicator means from the maximum count number position to the initial position by further opening of the first door means; and reset means operable when said second door means is opened to disable said interrupt means to permit said indicator means to be reset to said initial position.

It is accordingly an object of the present invention to provide an effective inexpensive tamper indicating container.

A further object is to provide a tamper indicating cassette in which opening of a door thereof advances a counter to provide a visible indication of the number of times such door has been opened up to a predetermined maximum.

A further object is to provide a tamper indicating cassette in which a numerical indication of the number of times a first door has been opened, up to a predetermined maximum count, is provided, and in which said indication may be reset to an initial position when a second door is opened.

With these and other objects, which will become apparent from the following description, in view, the invention includes certain novel features of construction and combinations of parts, one form or embodiment of which is hereinafter described with reference to the drawings which accompany and form a part of this specification.

DETAILED DESCRIPTION OF THE INVENTION

Figure 1:
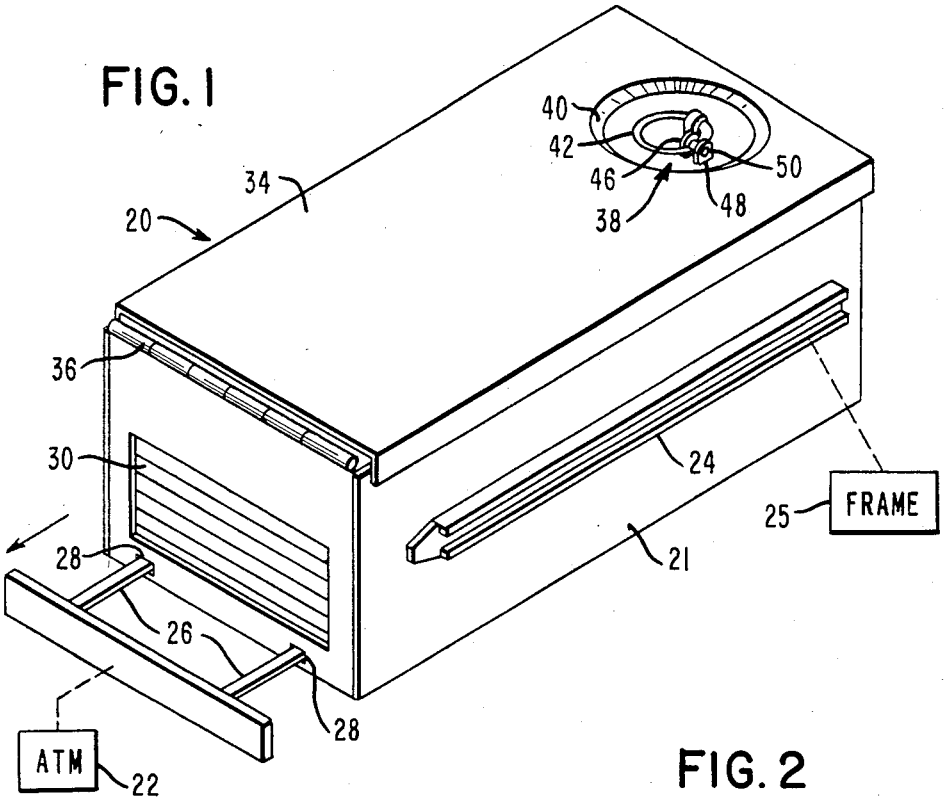
FIG. 1 is a perspective view of a currency cassette in which the present invention is embodied, also showing a portion of an ATM which the cassette is engaging.
Figure 2:
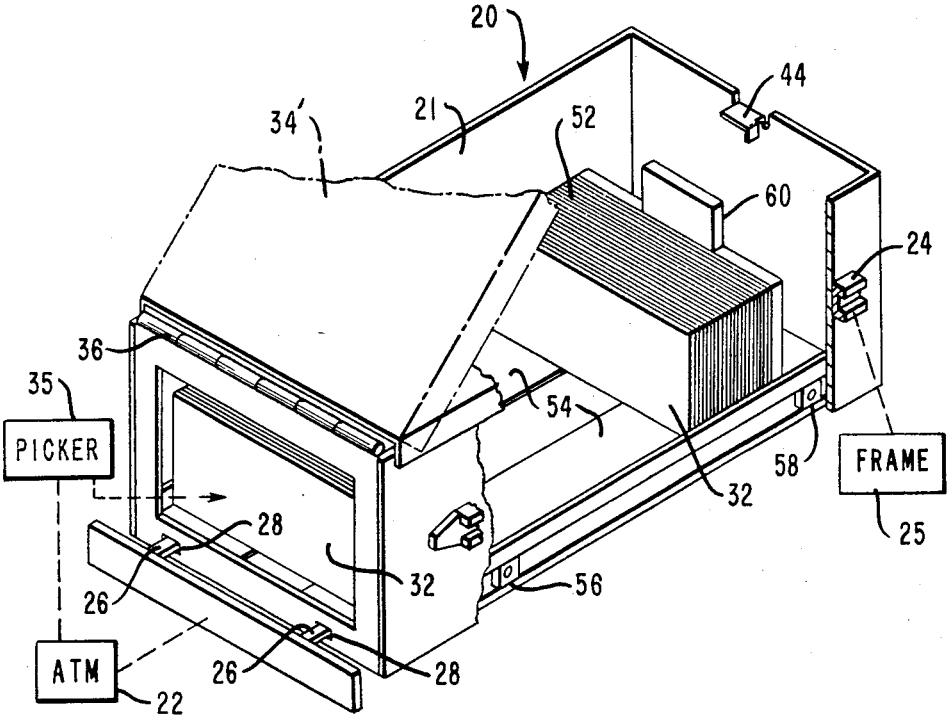
FIG. 2 is a perspective view, partially broken away, of a currency cassette in which the present invention is embodied, and the interior thereof, also showing a portion of an ATM with which the cassette is engaged.

Referring now to FIG. 1 of the drawings, a perspective view is shown of a currency cassette 20, in a position in which it is to be inserted into an ATM 22. In the illustrated embodiment, side rails 24 on each side of the casing 21 of the cassette 20 ride on a frame 25 in the ATM, and projections 26 of the ATM pass through slots 28 in the cassette 20 to engage mechanism within the cassette 20 to cause a shuttered door 30 , shown closed in FIG. 1, to open, as shown in FIG. 2, thereby enabling currency 32 (FIG. 2) to be picked from the cassette 20 by a picker 35 in the ATM 22. The ATM 22 may, for example, be a Class 5080 ATM marketed by NCR Corporation, Dayton, Ohio. The mechanism by which the projections 26 cause the opening of the door 30 forms no part of the present invention, and is disclosed in detail in the previously cited U.S. application Ser. No. 522,449. The cassette 20 also includes a second closure or lid 34 which is connected to the casing 21 by a hinge 36 and is movable between the closed position shown in FIG. 1 and the open position shown in dashed outline 34' in FIG. 2. When the cassette 20 is in operative relationship within the ATM 22, the lid 34 is closed as shown in FIG. 1; FIG. 2 is essentially a diagrammatic showing to facilitate a description of the cassette 20.

The cassette 20 (FIG. 1) also includes a seal 38 which is mounted in a well 40 to provide a device for locking the lid 34 in closed position, and providing a readily-ascertainable indication if the lid 34 has been opened by an unauthorized person. Locating the seal 38 in the well 40 presents a flush appearance of the cassette 20 to the ATM 22. The seal 38 includes a steel ring 42 which is used to rotate a finger lever (not shown) located under the lid to coast with a flange 44 to lock the lid 34 in the position shown in FIG. 1. After the cassette 20 is loaded with currency and prepared for use in an ATM, the ring 42 is pivoted to a vertical plane (as viewed in FIG. 1) and rotated in a clockwise direction to lock the lid 34 in closed position. Thereafter, the ring 42 is moved to the horizontal or flat position shown in FIG. 1 in which a portion of the ring lies between two spaced upright extensions 46 and 48 which are secured to the lid 34. A plastic "wire" (not shown) is then inserted through the openings 50 in the extensions 46 and 48 and "sealed." The lid 34 cannot be opened until the seal 38 is broken to permit the ring 42 to be raised to the vertically oriented operating plane mentioned. Breaking the seal 38 provides an indication that the lid 34 has been opened.

The cassette 20 is loaded with a stack 52 of currency 32 which is supported on a conventional currency support structure 54 which is detachably secured to the casing 21 by flanges 56 and 58, for example, which are secured to anchor areas (not shown) inside the cassette 20 so as to enable tne support structure 54 to be removed only when the lid 34 is in the open position, as shown at 34 in FIG. 2. The support structure 54 includes a back-up plate 60 which is biased by a spring (not shown) to urge the stack 52 of currency toward the picker mechanism 35. For a picking operation to take place, the door 30 must be open. The construction and operation of said door are shown and described in detail in the previously cited U.S. application Ser. No. 522,449. The stack 52 of bills in restrained at the open end of the cassette 20 by conventional means (not shown) so as to enable the picker mechanism 35 to pick successively the first bill 32 in the currency stack 52 to perform the cash dispensing function mentioned earlier herein. After a bill is picked, it is transferred by transport mechanisms (not shown) within the ATM to a receptacle, for example, where additional bills may be collected in response to the monetary amount requested by a customer, prior to making the bills accessible to the customer as a result of a routine cash dispensing operation.

Figure 3:
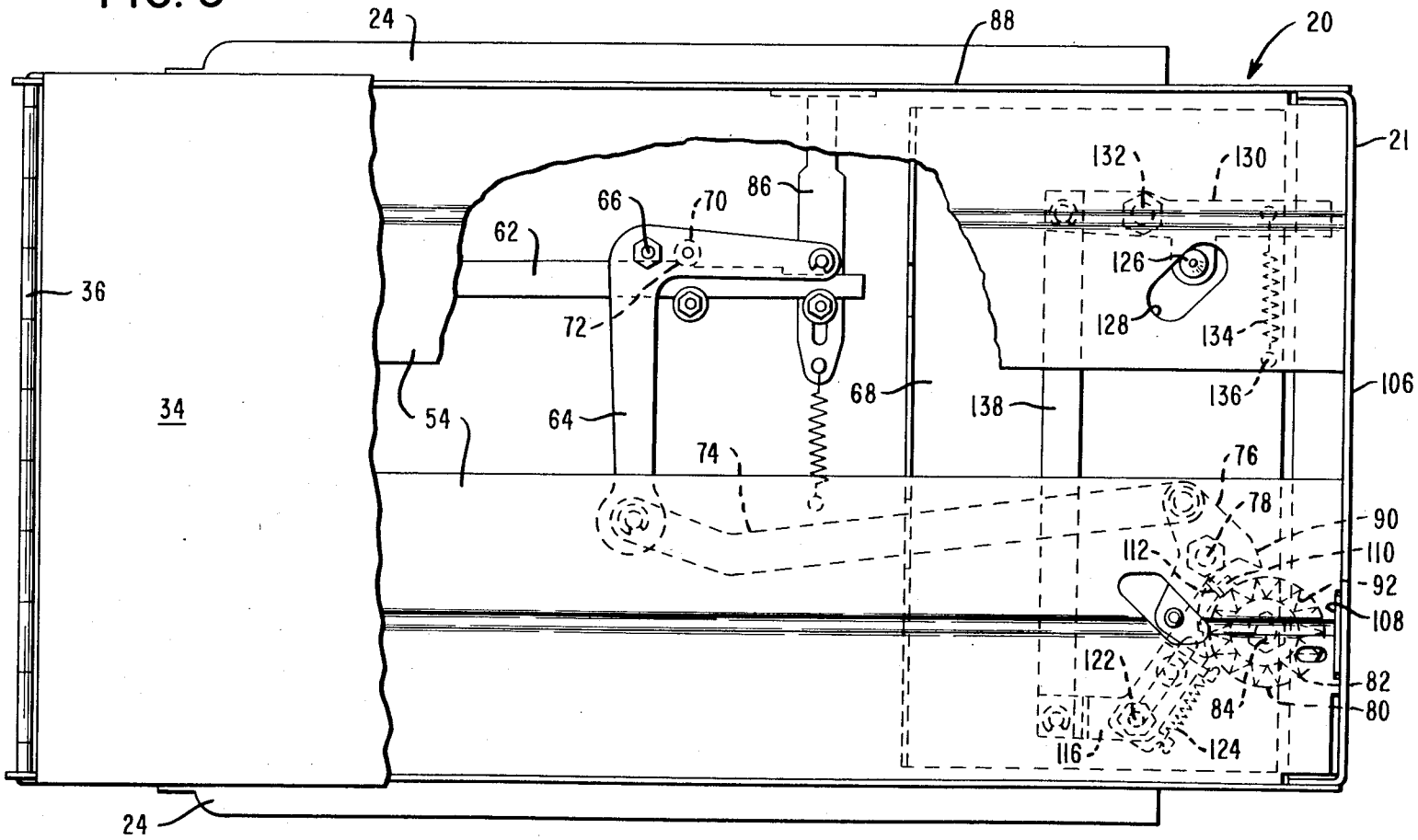
FIG. 3 is a plan view of the cassette of FIGS. 1 and 2, partially broken away, showing a first door-controlled mechanism for advancing the indicator and a second mechanism for operating a reset mechanism to enable the indicator to be reset to an initial position.

As explained in the previously-cited U.S. application Ser. No. 522,449, movement of the door 30 from closed to open position causes a camming lever 62 to be moved to the right as viewed in FIG. 3, while movement of said door from open to closed position causes movement of said lever to the left to the position in which it is shown in FIG. 3. A bell crank lever 64 is pivotally mounted on a pin 66 which is upstanding from and fixed to the bottom 68 of the casing 21. A stud 70 is fixed to the underside of bell crank lever 64 to coact with a cam surface 72 on the camming lever 62. When the camming lever 62 moves to the right, as viewed in FIG. 3, as the door 30 is being opened, the cam surface 72 and the stud 70 coact to rotate the bell crank lever 64 in a counterclockwise direction, which performs two functions. First, it acts through a link 74 to operate a pawl 76 which is rotatably mounted on a pivot 78 fixed to the floor or bottom 68 of the casing 21. The pawl 76 coacts with a ratchet wheel 80 fixed to an indicator 82. The combined ratchet wheel 80 and indicator 82 are rotatably mounted on a shaft 84 fixed to the bottom of the casing 21, and held on the shaft 84 by a fastener 85. Secondly, the crank lever 64 moves a slide member 86 out of the side wall 88 of the casing 21 to coact with an abutment member (not shown) of the ATM 22 to prevent the cassette 20 from being withdrawn from the ATM until the door 30 is closed.

Figure 5:
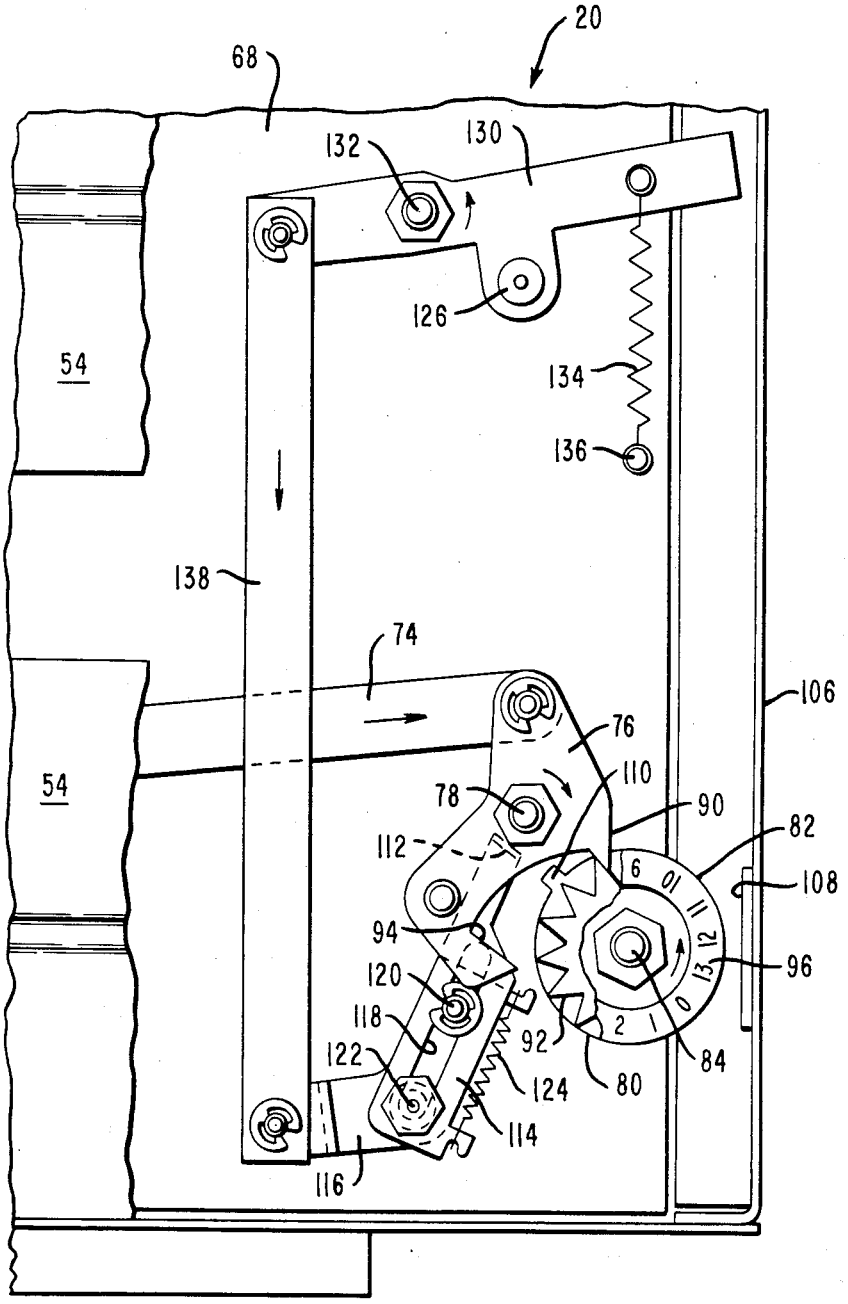
FIG. 5 is an enlarged fragmentary plan view of the cassette, similar to FIG. 4, and also showing the reset mechanism for disabling the interrupt mechanism.

When the crank lever 64 is rotated in a counterclockwise direction as viewed in FIG. 3, the pawl 76 rotates in a clockwise direction, causing a tooth 90 on the pawl 76 to engage one of the teeth 92 on the ratchet wheel 80, as best shown in FIG. 5. As the tooth 90 on the pawl 76 moves toward a tooth 92, a centering tooth 94, also on the pawl 76, moves out of engagement with the ratchet wheel 78, permitting the pawl 76 to index the ratchet wheel 78 one tooth or one position in a counterclockwise direction as viewed in FIG. 5. When the cassette 20 is removed from the ATM 22, the door 30 will be closed and the bell crank 64 will be rocked in a clockwise direction, shifting the link 74 to the left as viewed in FIG. 5 and causing the pawl 76 to rock about its pivot 78 in a counterclockwise direction to move the centering tooth 94 into engagement with the ratchet wheel 78, thereby retaining said wheel and the indicator 80 against movement, while the tooth 90 on the pawl 76 is rocked out of engagement with the ratchet wheel 78.

Figure 4:
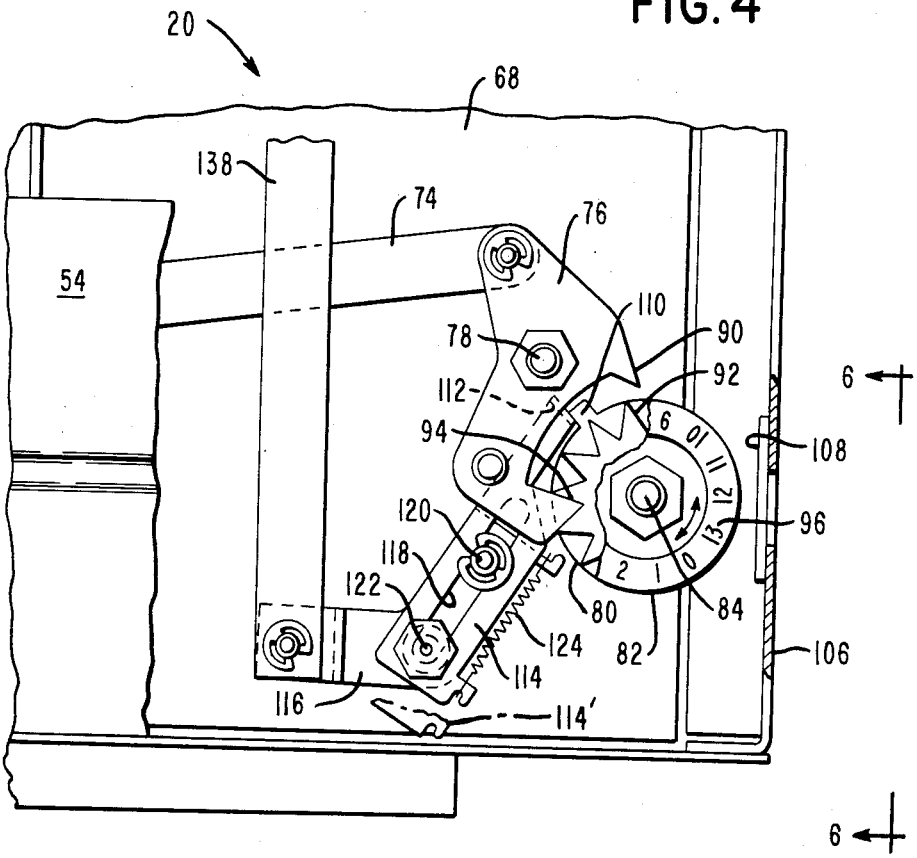
FIG. 4 is an enlarged fragmentary plan view of the cassette showing the indicator, the advancing mechanism therefor, and the interrupt mechanism for preventing further movement of the indicator past a predetermined maximum count.
Figure 6:
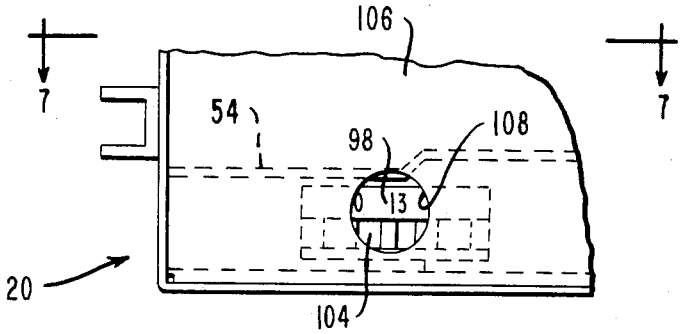
FIG. 6 is a fragmentary sectional view of the cassette taken along line 6—6 of FIG. 4 and showing the indicator and the arrangement by which it can be viewed from outside the cassette.
Figure 7:
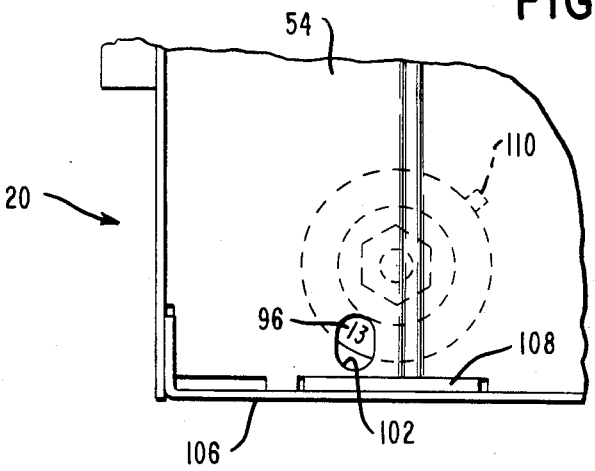
FIG. 7 is a fragmentary sectional view taken along line 7—7 of FIG. 6.
Figure 8:
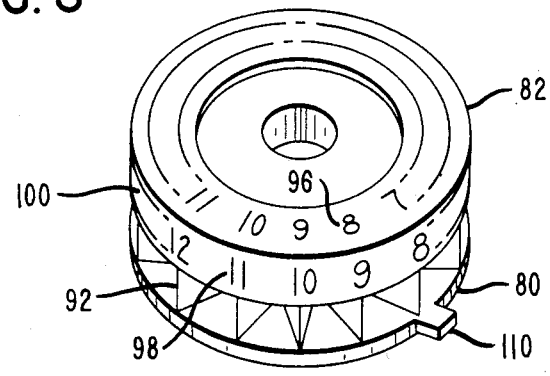
FIG. 8 is a perspective view of the indicator and the ratchet wheel to which it is fixed.
Figure 9:
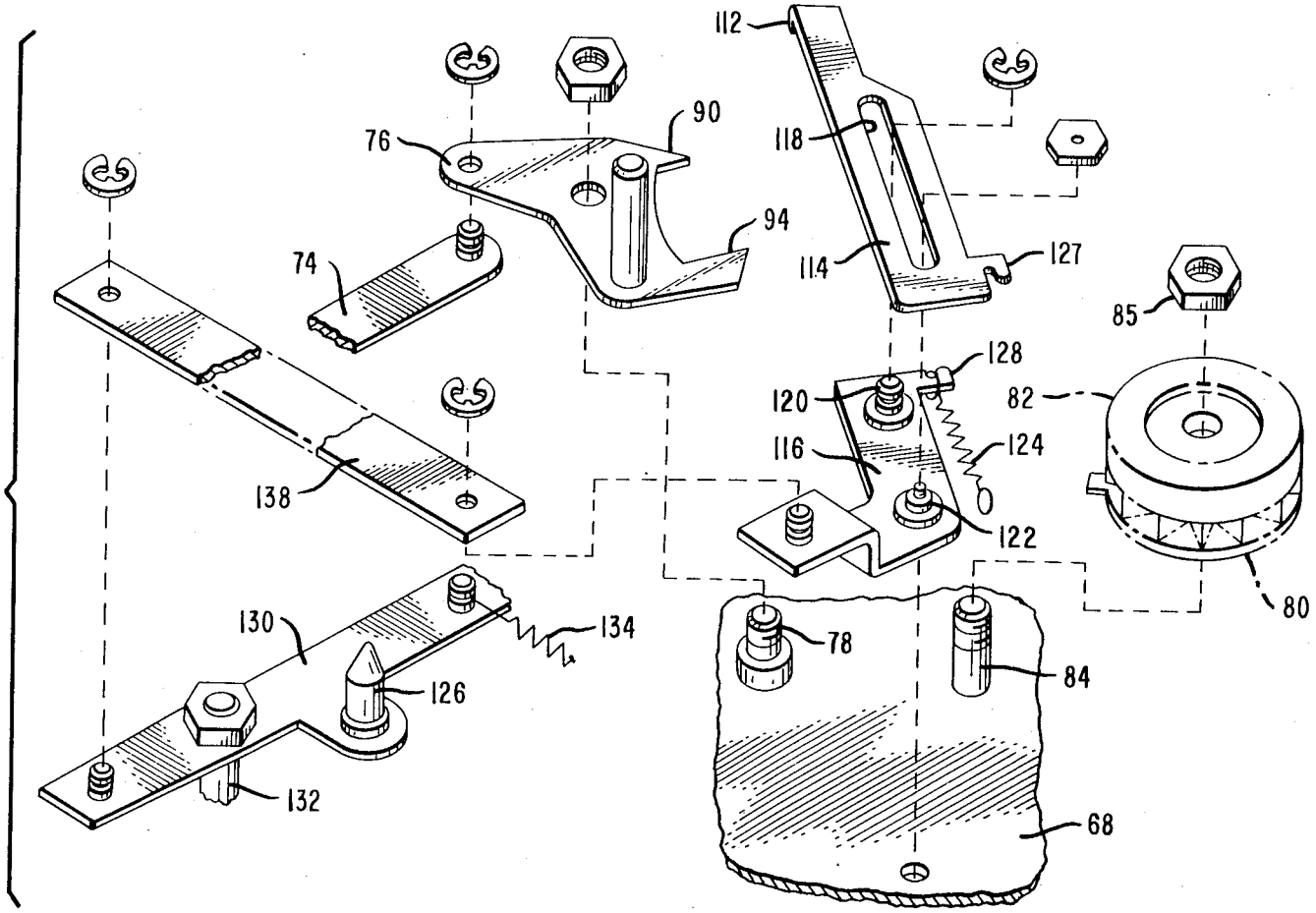
FIG. 9 is an exploded perspective view, showing the indicator and attached ratchet wheel, the pawl mechanism for advancing the ratchet wheel, the interrupt mechanism for halting further movement of the indicator and ratchet wheel, and the reset mechanism for disabling the interrupt mechanism.

As shown in FIGS. 4 and 6 to inclusive, the indicator is provided around the periphery of its top surface with consecutive numbers 96 for indicating the number of times that the door 30 has been opened. In addition, similar consecutive numbers 98 are provided along the vertical circumferential surface 100 of the indicator 82. In the illustrated embodiment of the invention, the numbers 98 are offset by one position from the numbers 96, as best shown in FIG. 8. Openings 102 and 104, in the support structure 54 and the rear wall 106, with a protective window 108 of glass or appropriate transparent material in the rear wall 106, are provided to enable the numbers 96 and 98 to be viewed from the interior and exterior of the cassette 20.

When the cassette 20 is filled with currency at a central location, the indicator is reset to a zero position, in a manner which will be subsequently described. Thereafter, each time the door 30 is opened, the pawl 76 coacts with the ratchet wheel 80 to advance the indicator by one position.

In the absence of other mechanism, the ratchet wheel 80 would continue to be advanced one position by the pawl 76 each time that the door 30 is opened, and would thus advance through the highest number of the indicator 82 and back to the zero position and beyond. It would thus be simple for a person wishing to obtain unauthorized access to the cassette 20 simply to continue to move the cassette 20 into and out of the ATM 22, thereby in effect erasing the indication on the indicator 82 of an unauthorized entry.

As indicated previously, some prior-art cassettes have means to cause a lock-up of the cassette door when more than a permitted number of openings of the cassette take place. However the locking of the cassette could result in damage to the cassette or ATM if an effort is made to force the cassette into the ATM. Also the locking of the cassette would prevent its use for any purpose until it has been reset at a central location. It may therefore be seen that a means of providing an indication of unauthorized opening of the cassette without causing locking of said cassette would be a useful feature. In such an arrangement, a sufficiently high number of allowable positions (13 in the illustrated embodiment) is provided that it would be unlikely that this capacity would ever be exceeded in legitimate use of the cassette.

This indication of unauthorized opening of the cassette is achieved in the present invention by the provision of a projection 110 on the ratchet wheel 80 which rotates with said ratchet wheel. A surface 112 on an arm 114 (FIGS. 3, 4, 5 and 9) is located in the circular path of movement of the projection 110 when the arm 114 is in a blocking position. The arm 114 is mounted for linear sliding movement on a second arm 116 by means of a slot 118 in the arm 114, in which ride a first stud 120 on the arm 116 and a second stud 122 which also serves as a pivot for rotatably mounting the arm 116 on the cassette floor 68. A spring 124 extending between projections 127 and 128 of the arms 114 and 116, respectively, urges the arm 114 upward to the right, as viewed in FIGS. 3, 4 and 5, toward a position of engagement with the projection 110.

It will be seen that when the surface 112 is positioned in the path of movement of the projection 110, and when the indicator is attempted to be operated from position 13 to position zero by interaction of the pawl 76 and the ratchet wheel 80, the projection 110 engages the surface 112 and shifts the arm 114 downward with respect to the arm 116 against the force of the spring 124, to a position partially shown in dashed outline 114'. Then, when the pawl is rocked counterclockwise as the cassette 20 is withdrawn from the ATM 22, the surface 112 moves the projection 110 backward in a clockwise direction under the force of the spring 124, to return the indicator to its former position 13. Ths continues to take place for each additional movement of the cassette 20 into and out of the ATM 22. A person inspecting the cassette can therefore note that the indicator is set to position 13, a higher-numbered position than it would be likely to have been set to in legitimate operations, and can question those who were responsible for custody of the cassette.

When the cassette 20 is returned to the central location for reloading, the seal 38 is broken and the lid 34 is opened to add currency to the cassette. Opening of the lid 34 exposes a manually operable handle 126 which extends through an opening 128 in the currency support structure 54. and which is fixed to a lever 130 pivotably mounted on a stud 132 secured to the cassette floor 68. The lever 130 is urged in a clockwise direction by a spring 134 extending between said levers and a stud 136 secured to the cassette floor 68. A link 138 couples the lever 130 to the arm 116.

When it is desired to reset the indicator 82 to its zero position, the handle 126 is grasped and is moved in a direction upward and to the right, as viewed in FIG. 3. This rocks the lever 130 in a counterclockwise direction about its pivot 132 against the force of the spring 134. This movement is transmitted by the link 138 to the arm 116, and rocks it in a counterclockwise direction about the pivot 122. The arm 114, which is carried by the arm 116, and the surface 112 on the arm 114, accordingly also are rocked in a counterclockwise direction. This shifts the surface 112 out of the path of movement of the projection 110 on the ratchet wheel 80, and permits the indicator 82 to be set manually to the zero position.

The cassette 20, after being reloaded with currency and having its indicator 82 reset to zero position, is once again ready to be transported from the central location to an ATM 22, in which it can be placed for the dispensing of currency.

While the form of the invention shown and described herein is admirably adapted to fulfill the objects aforesaid, it is to be understood that other and further modifications of the disclosed apparatus within the scope of the following claims may be made without departing from the spirit of the invention.

What is claimed is:

1. A tamper indicating container comprising:

a casing having first and second apertures therein;

first door means operatively associated with said first aperture and movable between open and closed positions;

second door means operatively associated with said second aperture and movable between open and closed positions;

means to secure said second door means in closed position and to provide an indication when said second door means has been opened;

means for moving said first door means to open position to enable items to be removed from said container, said first door means being movable to said closed position after a desired number of items have been removed therefrom;

indicator means movable incrementally from an initial position to a maximum count number position to provide an indication of the number of times up to the maximum that the first door means has been opened;

advancing means for advancing said indicator means incrementally each time up to the maximum that said first door means is opened;

interrupt means for preventing the advancing means from advancing the indicator means from the maximum count number position to the initial position by further opening of the first door means, without preventing operation of said means for moving said first door means; and reset means operable when said second door means is opened to disable said interrupt means to permit said indicator means to be reset to said initial position.

2. The tamper indicating container of claim 1, in which said interrupt means includes a projection on said indicator means, a surface on said interrupt means engageable with said projection, and a flexible coupling in said interrupt means which acts through said surface and said projection to return said indicator means to said maximum count number position each time said advancing means attempts to increment said indicator means past said maximum count number position.

3. The tamper indicating means of claim 2 in which said reset means coacts with said interrupt means to move said surface out of the path of movement of said projection to permit said indicator means to move from said maximum count number position to said initial position.

4. The tamper indicating container of claim 1 in which said indicator means has position-indicating indicia disposed around the periphery thereof.

5. The tamper indicating container of claim 1 in which said casing has a third aperture therein through which indicia on the indicator means may be viewed.

6. The tamper indicating container of claim 1 in which a transparent covering is provided for said third aperture.

7. The tamper indicating container of claim 6 in which said third aperture and transparent covering are provided at one end of said casing and in which a fourth aperture is provided in an interior surface of the casing for reading indicia disposed on the top surface of the indicator means.

8. A tamper indicating currency cassette comprising:

a casing having first and second apertures therein;

first door means operatively associated with said first aperture and movable between open and closed positions;

second door means operatively associated with said second aperture and movable between open and closed positions;

means to secure said second door means in closed position and to provide an indication when said second door means has been opened;

means operatively associated with a currency dispenser for moving said first door means to open position to enable currency to be removed by a picking mechanism from said cassette, said first door means being movable to said closed position after a desired amount of currency has been removed therefrom;

counter means movable incrementally from a zero position to a maximum count number position to provide a count of the number of times up to the maximum that the first door means has been opened;

interrupt means including a flexible coupling for preventing the indicator means from advancing from the maximum count number position to the zero position by further opening of the first door means, while continuing to permit said first door means to be opened; and means operable when said second door means is opened to disable said interrrupt means to permit said counter means to be reset to said zero position.

9. A tamper indicating currency cassette comprising;

a casing hving first and second apertures therein;

first door means operatively associated with said first aperture and movable between open and closed positions;

second door means operatively associated with said second aperture and movable between open and closed positions;

means to secure said second door means in closed position and to provide an indication when said second door means has been opened;

means forming part of a currency dispenser for moving said first door means to open position to enable currency to be removed by a picking mechanism from said cassette when said cassette is placed in said currency dispenser, said first door means being movable to said closed position when said cassette is removed from said currency dispenser;

a rotatable indicator movable incrementally from a zero position to a maximum count number position to provide a count of the number of times, up to the maximum, that the first door means has been opened;

rotatable ratchet means fixed to said indicator and movable each time said first door means is opened to cause corresponding movement of said indicator;

pawl means cooperating with said ratchet means for advancing said ratchet means incrementally and for retaining said ratchet means in position when it is not being advanced;

means operatively coupled to said first door means to cause said pawl means to advance said ratchet means each time that said first door means is opened;

a projection extending radially from said ratchet means, fixed thereto and rotatable therewith;

interrupt means movable between first and second positions comprising a first pivotally mounted arm, a second arm spring-coupled to said first arm for linear movement in alignment with said first arm, said second arm having a surface thereon engageable with said projection when said interrupt means is in said first position and when said indicator is at its maximum count number opposition, to prevent further advancing of said indicator, said surface being located out of the path of movement of said projection when said interrupt means is in said second position; and reset means operable when said second door means is opened to move said interrupt means to said second position, and thereby to permit said indicator to be advanced from said maximum count number position to said zero position.

* * * * *